United States Patent [19]

Ochiai et al.

[11] 4,142,392

[45] Mar. 6, 1979

[54] INTERNALLY GROOVE FORMING APPARATUS FOR HEAT EXCHANGING PIPES

[75] Inventors: Izumi Ochiai; Masahiro Miyagi, both of Ohiramachi; Yoichi Wakabayashi, Sano, all of Japan

[73] Assignee: Hitachi, Ltd., Japan

[21] Appl. No.: 832,540

[22] Filed: Sep. 12, 1977

[30] Foreign Application Priority Data

Apr. 20, 1977 [JP] Japan ..... 52-44474

[51] Int. Cl.[2] ..... B21D 17/04

[52] U.S. Cl. ..... 72/113; 72/264

[58] Field of Search ..... 72/113, 264, 269; 29/157.3 A

[56] References Cited

U.S. PATENT DOCUMENTS

| | | | |
|---|---|---|---|
| 649,341 | 5/1900 | Nevill | 72/113 |
| 1,017,569 | 2/1912 | Lewis | 72/113 |
| 2,367,226 | 1/1945 | Lonsdale | 29/157.3 A |
| 2,779,222 | 1/1957 | Edwards | 29/157.3 A |
| 3,808,860 | 5/1974 | Yamaguchi et al. | 72/264 |

*Primary Examiner*—Lowell A. Larson

*Attorney, Agent, or Firm*—Craig & Antonelli

[57] ABSTRACT

An internal groove forming apparatus for heat exchanging pipes, having a cylindrical holder adapted to be loosely fitted in a heat exchanging pipe in concentric relationship, and a plurality of groove forming rolling tools arranged on the holder in a plurality of axially spaced, circumferentially oriented rows and rotatably supported on the holder in such a manner that the rolling tools of one of the two adjacent rows are disposed in staggered relationship with respect to those of the other and an imaginary circle circumscribing the rolling tools is interposed between an outer peripheral surface and an inner peripheral surface of the heat exchanging pipe. Axial relative movements of the heat exchanging pipe and the holder enable the rolling tools to form a number of substantially axially oriented grooves on the inner peripheral surface of the heat exchanging pipe.

3 Claims, 8 Drawing Figures

INTERNALLY GROOVE FORMING APPARATUS FOR HEAT EXCHANGING PIPES

This invention relates to an apparatus for forming a number of grooves on an inner surface of a heat exchanging pipe which grooves extend parallel to the axis of the pipe or extend at an angle with respect thereto.

The provision of a number of grooves on an inner peripheral surface of a heat exchanging pipe enables the capacity of the heat exchanging pipe to perform heat exchange between a refrigerant flowing through the pipe and a fluid flowing outside the pipe to be increased. This makes it possible to obtain an overall compact size in a heat exchanger and to economize on material. Heretofore, it has been customary to use an apparatus for forming grooves on an inner surface of a heat exchanging pipe which, as shown in FIG. 1, includes a cylindrical mandrel 1 formed on its outer periphery with longitudinally extending ridges 1*a* of a shape which conforms to the shape of grooves 2*a* to be formed on the inner surface of a heat exchanging pipe 2. The mandrel 1 is force fitted in the heat exchanging pipe 2 to form the grooves 2*a* by the ridges 1*a*.

Japanese Pat. Laid-Open No. 1469/74 discloses an apparatus similar to that illustrated in FIG. 1, except that ridges extend at an angle to the longitudinal axis of the mandrel.

Some disadvantages are associated with the aforementioned apparatus of the prior art. Difficulty is encountered in reducing the spacing between the grooves 2*a* in working on the mandrel, so that it is impossible to provide a large number of grooves 2*a* on the inner surface of the heat exchanging pipe and hence to increase the capacity of the heat exchanging pipe to effect heat exchange. Also, when the grooves 2*a* are formed, there is great frictional dragging of the ridges 1*a* of the mandrel 1 on the heat exchanging pipe 1, with a result that the mandrel 1 has a short life. This makes the apparatus uneconomical. A high working force is required because of seizure at the interfaces of the grooves 2*a* and the ridges 1*a*, and this makes it impossible to speed up the groove forming operation.

An object of the present invention is to provide an apparatus for forming grooves on an inner surface of a heat exchanging pipe which makes it possible to form grooves of a desired number.

Another object is to provide an apparatus for forming grooves on an inner surface of a heat exchanging pipe comprising groove forming rolling tools which have reduced frictional dragging on the inner surface of the pipe, so that the service life of the groove forming apparatus can be increased and a groove forming operation can be speeded up.

According to the invention, the aforementioned objects can be accomplished by an apparatus for forming a number of substantially longitudinally extending grooves on an inner surface of a heat exchanging pipe, comprising a cylindrical holder adapted to be loosely fitted in the heat exchanging pipe in concentric relationship thereto, and a plurality of rolling tools rotatably mounted on the cylindrical holder, the rolling tools being circumferentially offset and axially spaced apart from each other, in which an imaginary circle subscribing the rolling tools is interposed between an outer peripheral surface and an inner peripheral surface of the heat exchanging pipe, and in which axial relative movements of the heat exchanging pipe and the cylindrical holder cause the rolling tools to form a number of substantially longitudinally extending grooves on the inner peripheral surface of the heat exchanging pipe.

Preferred embodiments of the invention will now be described with reference to FIGS. 3 to 8.

Figure 3:
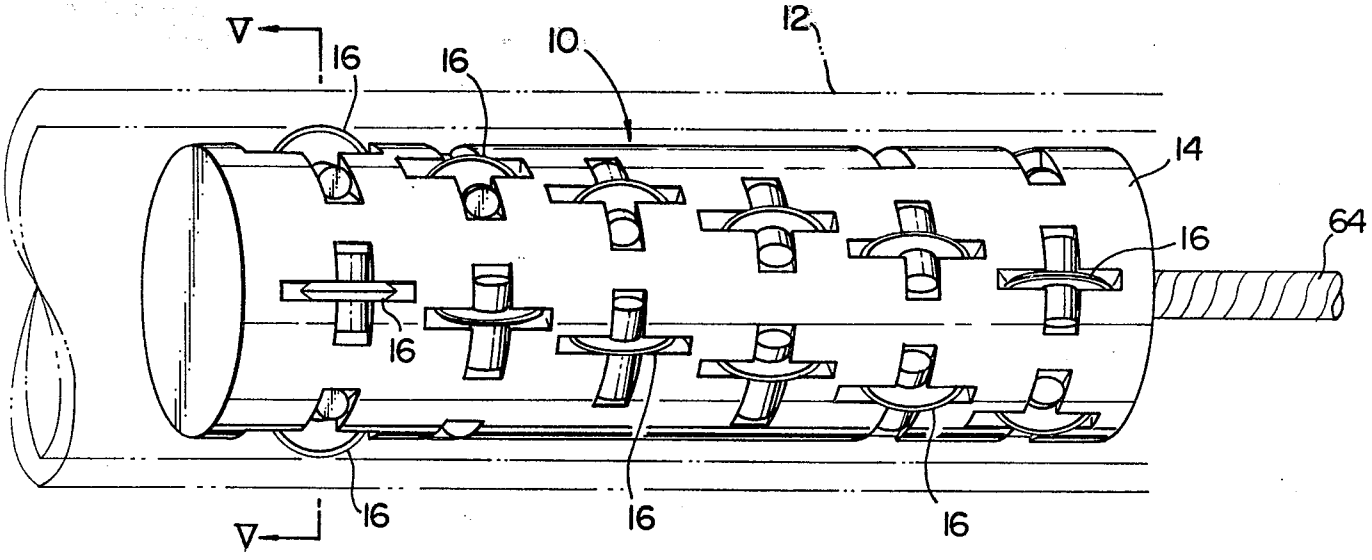
FIG. 3 is a perspective view of a groove forming apparatus comprising one embodiment of the invention.

Referring to FIGS. 3 to 7, the groove forming apparatus according to the invention generally designated by the reference numeral 10 includes a cylindrical holder 14 adapted to be loosely fitted in a heat exchanging pipe 12, and a number of groove forming rolling tools 16 rotatably supported on the cylindrical holder 14 as shown in FIG. 3. The tools 16 are arranged on the holder 14 in a plurality of axially spaced, peripherally oriented rows. Each of the plurality of peripherally oriented rows includes a plurality of tools 16 which are circumferentially spaced apart from each other. The tools 16 of one of the two adjacent rows are disposed in staggered relationship with respect to those of the other.

Figure 1:
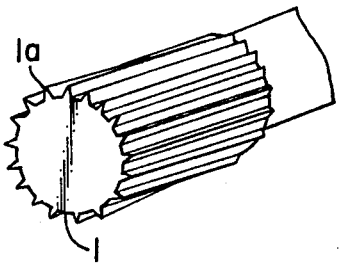
FIG. 1 PRIOR ART
FIG. 1 is a perspective view of a prior art mandrel for forming grooves on an inner peripheral surface of a heat exchanging pipe.
Figure 2:
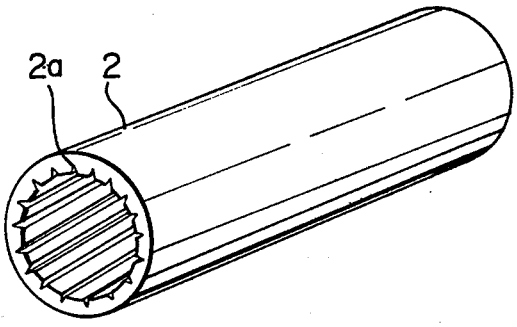
FIG. 2 PRIOR ART
FIG. 2 is a perspective view of a heat exchanging pipe in which grooves are formed by the prior art mandrel shown in FIG. 1.
Figure 4:
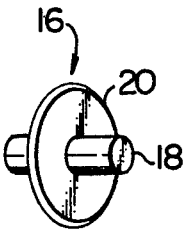
FIG. 4 is a perspective view of a groove forming rolling tool.
Figure 5:
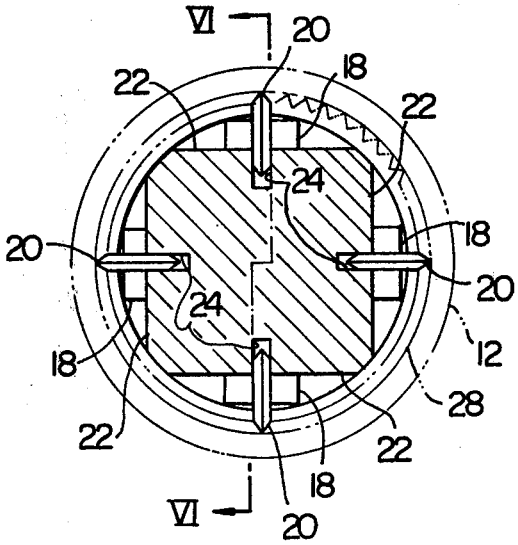
FIG. 5 is a sectional view taken along the line V—V of FIG. 3.
Figure 6:
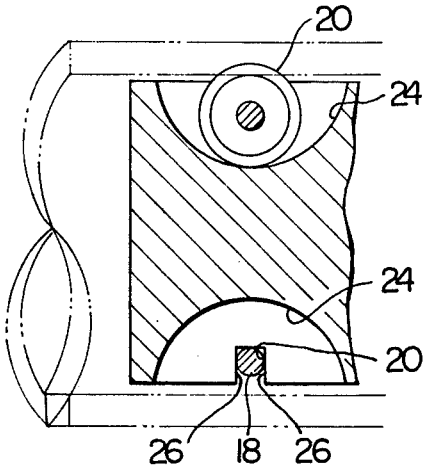
FIG. 6 is a sectional view taken along the line VI—VI of FIG. 5.

As can be clearly seen in FIG. 4, each rolling tool 16 includes a roller 18, and a groove forming wheel 20 fixed to the roller 18 and disposed concentrically therewith. As shown in FIGS. 5 and 6, each roller 18 is rotatably fitted in a transverse groove 22 formed in the holder 14, and each groove forming wheel 20 is slidably fitted in a milled axial groove 24 formed in the holder 14 so as to prevent extensive displacements of each tool 16 axially and transversely of the holder 14. When each tool 16 is mounted on the holder 14, tops 26 of the wall of each transverse groove 22 are calked by a punch to prevent dislodging of the tool 16 from the holder 14.

As can be seen in FIG. 5, it will be understood that when all the tools 16 are mounted on the holder 14, an imaginary subscribed circle 28 formed by the groove forming wheels 20 is interposed between an inner peripheral surface and an outer peripheral surface of the heat exchanging pipe 12.

Figure 7:
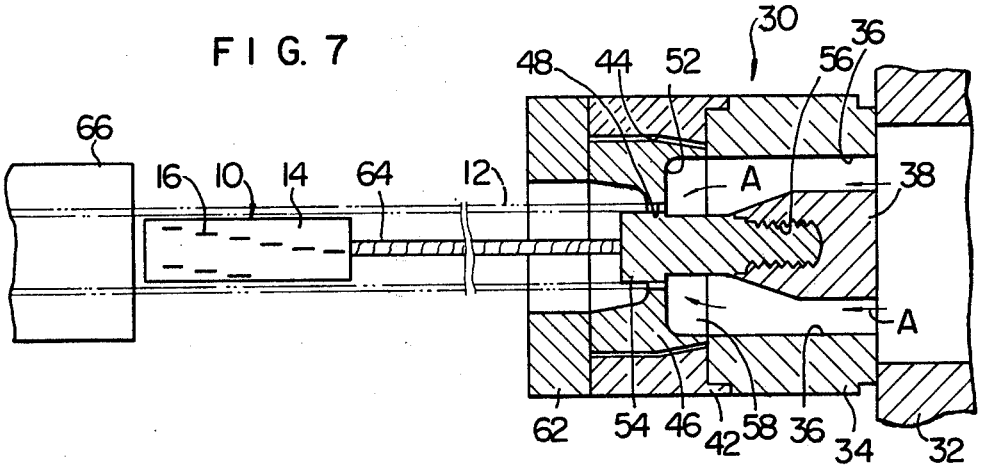
FIG. 7 is a schematic view showing the manner in which the groove forming apparatus according to the invention is put to use.

Referring to FIG. 7, the groove forming apparatus 10 according to the invention is used with a port hole die assembly 30 connected to a container 32 for aluminum alloy billets. The port hole die assembly 30 comprises a port member 34 connected to the container 32. The port member 34 includes therein a plurality of circumferentially equi-distantly spaced and axially extending port holes 36 communicating with the opening of the container 32 and a central portion 38. The port hole die assembly 30 further includes a die 42 connected to the port member 34 coaxially therewith and formed in its central portion with a die tip fitting hole 44. The die tip 46 is fitted in the die tip fitting hole 44 of the die 42 and formed in its central portion with a port hole 48 and at its back with a recess 52. A mandrel 54 has threaded one end portion threadably fitted in an internally threaded hole 56 formed in one end portion of the central portion 38 and the other end portion which loosely extends through the port hole 48 of the die tip 46. The recess 52 of the die tip 46 cooperates with an outer peripheral surface of the mandrel 54 to define a mixing chamber 58. A back die 62 is mounted on front surfaces of the die 42 and die tip 46. The groove forming apparatus 10 is connected by a connecting means 64 such as a wire to a front surface of the mandrel 54 for rotation relative to the mandrel. The reference numeral 66 designates a cooling device.

In operation, a billet formed of an aluminum alloy is fed under pressure from the container 32. As indicated by arrows A in FIG. 7, the billet is divided into segments as it passes through the port holes 36 which segments are combined into a blank again in the mixing chamber 58, so that the metallic structure of the aluminum alloy is rendered uniform. The blank passes through a clearance between the die tip 46 and the mandrel 54 to be formed into a pipe 12 of a predetermined thickness. The heat exchanging pipe thus formed passes over the groove forming apparatus 10. Axial relative movements of the pipe 12 and the groove forming apparatus 10 cause the forming wheels 20 to form a number of parallel, axially oriented grooves on the inner peripheral surface of the heat exchanging pipe 12. Thereafter, the heat exchanging pipe 12 is cooled by means of the cooling device 66, thereby completing the heat exchanging pipe having grooves formed on its inner surface.

Figure 8:
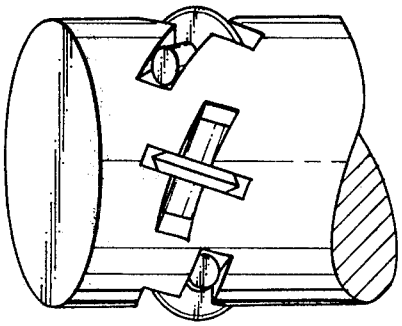
FIG. 8 is a fragmentary perspective view of a modification of the apparatus according to the invention which modification is effective to form spiral grooves on the inner surface of the heat exchanging pipe.

FIG. 8 shows a modification of the apparatus according to the invention. As shown, the roller 18 and groove forming wheel 20 of each rolling tool 16 has an axis thereof which extends at an angle to the longitudinal axis of the holder 14. Thus axial relative movements of the heat exchanging pipe 12 and the holder 14 cause the forming wheels 20 to form a number of spiral grooves on the inner surface of the heat exchanging pipe 12.

In the apparatus for forming grooves on an inner surface of a heat exchanging pipe according to the invention, the groove forming wheels 20 are small in diameter and rotatable, so that frictional dragging of the wheels 20 on the heat exchanging pipe 12 is greatly reduced as compared with the frictional dragging of a conventional mandrel on the latter. This is conductive to increased service life of the groove forming apparatus. Moreover, since there is no seizure at the interfaces of the wheels 20 and the inner surface of the heat exchanging pipe 12, grooves can be formed with a low force and a groove forming operation can be performed with increased speed. The arrangement in which the wheels 20 are located on the outer periphery of the holder 14 in a plurality of axially spaced, peripherally oriented rows with the wheels 20 of the two adjacent peripherally oriented rows being disposed in staggered relationship, makes it possible to reduce as desired the peripheral spacing of the grooves formed on the inner surface of the pipe 12. More specifically, the wheels 20 of the first row are mounted on the holder 14 in such a manner that they are peripherally spaced from one another to make working and mounting possible, the wheels 20 of the second row axially spaced from the first row are mounted such that the wheels are circumferentially offset from the wheels of the first row a distance equal to the desired groove spacing, and the wheels 20 of the next following rows are mounted until the grooves of the desired number can be formed. This arrangement eliminates problems which have hitherto been raised in working on the pipe 12 and makes it possible to form grooves of the desired number on the inner surface of the heat exchanging pipe. The heat exchanging pipe produced by the apparatus according to the invention has an increased heat exchanging capacity. Moreover, since the holder 14 is connected to the mandrel 54 through the wire 64, it is possible automatically to form grooves on the inner surface of the heat exchanging pipe 12 at a temperature suitable for a groove forming operation as the pipe 12 is released from the port hole die assembly 30.

From the foregoing description, it will be appreciated that the apparatus for forming grooves on an inner surface of a heat exchanging pipe enables groove spacing to be reduced, groove forming to be effected with increased speed with a lower working force, and grooves to be formed when the pipe is at a suitable temperature. Moreover, the apparatus has a long service life.

We claim:

1. An apparatus for forming a number of substantially longitudinally extending grooves in an inner surface of a heat exchanging pipe with the inner surface having therein no grooves in its initial form, comprising a cylindrical holder adapted to be loosely fitted in the heat exchanging pipe in concentric relation thereto;

a plurality of rolling tools rotatably mounted on said cylindrical holder, said rolling tools each having a single peripheral tip, in which an imaginary circle subscribing said rolling tools is interposed between an outer peripheral surface and an inner peripheral surface of the heat exchanging pipe; and said plurality of rolling tools being arranged in a plurality of axially spaced, circumferentially oriented rows, each of said circumferentially oriented rows including a plurality of said rolling tools circumferentially spaced apart from and generally aligned with each other, the rolling tools in one of two adjacent rows being disposed in staggered relationship with respect to those in the other row;

and in which axial relative movements of the heat exchanging pipe and said cylindrical holder cause said tools to form a number of substantially longitudinally extending grooves in the inner peripheral surface of the heat exchanging pipe.

2. An apparatus as set forth in claim 1 which is adapted to be used with a port hole die assembly, further comprising means for connecting said holder to the port hole die assembly while said holder is rotatable relative to the port hole die assembly.

3. An apparatus as set forth in claim 1, wherein said rolling tools each have an axis of rotation extending at an angle to the longitudinal axis of said holder.

* * * * *